US005411333A

United States Patent [19]

Hoffman

[11] Patent Number: 5,411,333

[45] Date of Patent: May 2, 1995

[54] RECYCLABLE DRAWER SLIDE

[75] Inventor: Keith A. Hoffman, Hudsonville, Mich.

[73] Assignee: Knape & Vogt Manufacturing Company, Grand Rapids, Mich.

[21] Appl. No.: 109,689

[22] Filed: Aug. 20, 1993

Related U.S. Application Data

[63] Continuation-in-part of Ser. No. 934,423, Aug. 24, 1992, Pat. No. 5,316,389, and a continuation-in-part of Ser. No. 932,718, Aug. 20, 1992, abandoned.

[51] Int. Cl.[6] ..... F16C 29/04

[52] U.S. Cl. ..... 384/18; 384/21

[58] Field of Search ..... 384/18, 21, 19, 48, 384/54, 59; 312/334.11, 334.12

[56] References Cited

U.S. PATENT DOCUMENTS

| | | | |
|---|---|---|---|
| 2,277,702 | 3/1942 | Kennedy | 45/77 |
| 2,277,703 | 3/1942 | Kennedy | 45/77 |
| 2,859,070 | 11/1958 | Gomersall . | |
| 2,981,584 | 4/1961 | Friend | 312/337 |
| 3,092,429 | 6/1963 | Barnes | 312/333 |
| 3,123,419 | 3/1964 | Maxwell | 312/333 |
| 3,141,714 | 7/1964 | Valitus | 312/348 |
| 3,142,517 | 7/1964 | Ward . | |
| 3,243,247 | 3/1966 | Knape | 312/333 |
| 3,259,447 | 7/1966 | Deutsch | 312/348 |
| 3,278,250 | 10/1966 | Vogt | 312/339 |
| 3,589,778 | 6/1971 | Olson . | |
| 3,649,087 | 3/1972 | Thomas | 384/21 |
| 3,782,800 | 1/1974 | Remington | 312/333 |
| 3,937,531 | 2/1976 | Hagen . | |
| 3,954,315 | 5/1976 | Sanden | 312/333 |
| 3,995,927 | 12/1976 | Stein | 312/333 |
| 4,065,196 | 12/1977 | Stein | 312/333 |
| 4,274,689 | 6/1981 | VanderLey | 312/333 |
| 4,423,914 | 1/1984 | VanderLey | 312/333 |
| 4,441,772 | 4/1984 | Fielding | 312/330 |
| 4,473,262 | 9/1984 | Staye | 312/333 |
| 4,480,878 | 11/1984 | Leiper . | |
| 4,560,212 | 12/1985 | Papp . | |
| 4,662,761 | 5/1987 | Hoffman | 384/18 |
| 4,765,669 | 8/1988 | Bessinger | 312/339 |
| 5,181,781 | 1/1993 | Wojcik | 384/18 |

*Primary Examiner*—Lenard A. Footland

*Attorney, Agent, or Firm*—Price, Heneveld, Cooper, DeWitt & Litton

[57] ABSTRACT

A drawer slide assembly comprising two or more channel pieces is fabricated from both plastic and metal materials. Specifically, the channel pieces are made up of formed steel and certain individual components such as stops, cushions and ball retainers are made of plastic. The invention behind the present concept is usage of detents, tabs and projections to retain the plastic components in their positions while maintaining the functional integrity of these individual items as they function within the drawer slide.

21 Claims, 9 Drawing Sheets

RECYCLABLE DRAWER SLIDE

CROSS-REFERENCE TO RELATED APPLICATION

This application is a continuation-in-part of U.S. patent application Ser. No. 07/934,423, filed Aug. 24, 1992, now U.S. Pat. No. 5,316.389, entitled DRAWER SLIDE ASSEMBLY, by Keith A. Hoffman; and U.S. patent application Ser. No. 07/932,718, entitled PRECISION DRAWER SLIDE MEMBER, by Keith A. Hoffman, tile disclosures of which are incorporated herein by reference.

FIELD OF THE INVENTION

The present invention relates to drawer slides. More specifically it relates to drawer slides for mounting drawers in cabinets wherein the components of the drawer slide may be disassembled or segregated for recycling purposes.

BACKGROUND OF THE INVENTION

Drawer slides have long been used as devices to facilitate installation of drawers in cabinets. The typical drawer slide contains two or more metal channel-shaped members which are slidable in a longitudinal fashion. The sliding movement may come about by rollers or ball bearings, or combinations of the same; however, they derive a longitudinal movement and are capable of handling a load as would be anticipated in the particular drawer application. Also of concern in many drawer slide designs is the fact that the load will be, in essence, cantilevered well forward of the mounting points of the drawer slide itself.

Thus, it has arisen that numerous drawer slide designs have evolved over the years. These designs have incorporated metal and plastic components for the most part. The metal and plastic componentry of such slides has been integrated to the point that the prior art has made it virtually impossible to separate the different components of drawer slide products for the purpose of recycling.

The prior art evolved in this fashion for the reason that the load requirements of the drawer slide product have both a lateral and vertical component. For instance, the drawer slide must stop travel of the drawer in both the opening and closing directions. When the drawer is carrying a load which is added to the load of the drawer and the drawer slide assembly, the opening or closing force which is asserted upon the components required to stop the drawer movement can be significant.

Most of the prior art utilizes stopping elements which combine plastic materials with the metal construction of the drawer slide. These materials must be fastened adequately to the channel elements of the slide so as to prevent disengagement during the stopping process.

Other prior art is known where the drawer slide is manufactured in such a way that one of the last operations is the forming of a tab on one of the channels which prevents, without great effort and deformation of the tab, removal of any of the plastic pieces associated with the slide function. Such impediments to removal greatly reduce the inclination of individuals to recycle the components of the slide for the reason that the disassembly process requires great effort and/or special tools.

In addition to the foregoing, there are other components of the typical drawer slide which integrate plastics with metal channel construction. For instance, stay-closed features which keep the slide in a closed position may comprise a rubber grommet or "peanut" which provides a surface which can be gripped by elements of the drawer slide channel. Fastening of these elements to the drawer slide channel construction by means of riveting, gluing or staking prevents their separation from the drawer slide at the time it is removed from service.

There are other components of drawer slide construction, such as ball retainer rollers and the like, which are prohibited from segregation for recycling purposes either owing to the complexity of the segregation of other elements of the drawer slide which are mechanically affixed to the channel pieces, or they themselves have been affixed in such a way as to prohibit easy removal.

There has been a longstanding history of shortsightedness in the drawer slide industry with respect to recycling. As a result, the present invention overcomes these shortcomings by comprehensively designing into the drawer slide product componentry which can be easily installed, function according to the anticipated requirements, and thereafter, once the product is removed from service, be segregated from the metallic recyclable components.

SUMMARY OF THE INVENTION

A drawer slide assembly comprising two or more channel pieces is fabricated from both plastic and metal materials. Specifically, the channel pieces are made up of formed steel and certain individual components such as stops, cushions and ball retainers are made of plastic. The invention behind the present concept is usage of detents, tabs and projections to retain the plastic components in their positions while maintaining the functional integrity of these individual items as they function within the drawer slide.

According to narrower aspects of the invention, drawer slide stops are contoured to fit the inner profile of a drawer slide channel wherein they additionally include projections which can be press fit into corresponding receiving holes within the channel members, such selection of projections and holes being generally transverse to the forces applied in closing and opening the slide, so as to diffuse the energies and load asserted onto the stop components in a way that would not in the norm cause them to become disengaged from the channel. The utilization of such components between channel elements, such as a cabinet stop between a cabinet channel and a center channel, allow its retention within its installed position on the cabinet channel by reason of its form fitting contours, while nesting compatibly between the outside profile of the center channel and the inside profile of the cabinet channel. The drawer slide of the present invention may also use a stop lever assembly wherein the stop lever is insertable into a detent area located on the main body of the center channel, and where the stop lever assembly includes a projection that compatibly seats within the corresponding hole for retaining and locating said stop lever assembly. The foregoing may be used in combination with an end stop cushion which is press fit onto an upright tab formed from a portion of the cabinet channel and where it may be reversibly removed from the tab, for the purposes of segregation prior to recycling. The foregoing preferably comprise all of the plastic components of the drawer slide of the present invention, which in cooperation are removable by hand or by hand tools, and which may cause disassembly of the subject slide in a matter of seconds.

DESCRIPTION OF THE PREFERRED EMBODIMENTS

Figure 2:
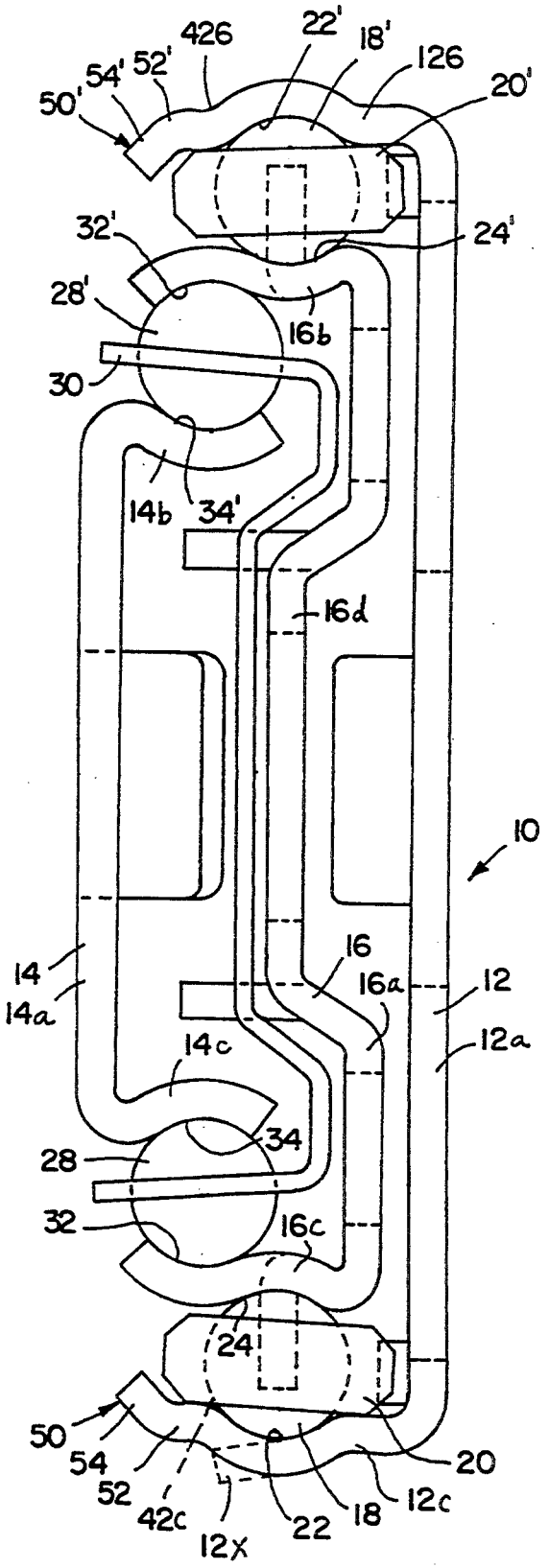
FIG. 2 is a cross-sectional view of the drawer slide in FIG. 1.

Referring now to the drawings, the drawer rail assembly 10 in the illustrative form of the invention set forth is shown to include an outer rail or channel 12, an intermediate rail or channel 16, and an inner rail or channel 14. The terms "rail" and "channel" are typically used in the trade interchangeably. In the illustrated embodiments of the invention, the slide assemblies, or simply "slides" as they are more commonly called, are arranged with their elongated axis horizontal, their smaller dimension being oriented vertically, and the thickness thereof being horizontal laterally. Typically, two such slide assemblies are employed, one on each side of a drawer or file, these being identical to each other except being in mirror image. For convenience, only one such slide assembly will be described in detail. In this description, the terms "vertical," "horizontal," "lateral," "above," "below," etc. are employed because of the particular orientation of the components as illustrated and as most commonly used. It will be realized, however, that the slides can be employed in pairs one above the other and spaced therefrom such that the vertical dimension in FIG. 2, for example, will then be horizontal. Therefore, these relative directional terms are set forth for convenience and are not intended to be limiting of the particular orientation of the invented slide assembly.

The rails are of generally C-shaped cross section as is commonly done. That is, outer rail 12 has a main vertical mounting panel or leg **12*a*, an upper generally horizontally extending leg 12*b*, and a lower generally horizontally extending leg 12*c*. In legs 12*b* and 12*c* are arcuate radiused concave ball bearing receiving races or tracks 22 and 22' to receive the ball bearings 18 and 18' of the outer, lower and upper bearings. These ball bearings are in a series, axially spaced from each other by the retainers 20 and 20'. Preferably, the upper and lower legs 12*b* and 12*c* also extend beyond the usual termination points 42*b* and 42*c* to include abutment extensions 50 and 50' each composed of intermediate sections 52 and 52' which are at an obtuse angle to the end of the arcuate portion, and terminal portions 54 and 54' which are at an obtuse angle to the intermediate sections 52 and 52'**. The details and advantages of this particular configuration are set forth in co-pending application Ser. No. 932,718, filed Aug. 20, 1992, and entitled PRECISION DRAWER SLIDE MEMBER, abandoned.

Intermediate rail 16 also includes a main vertically oriented panel or leg **16*a*, an upper generally horizontally extending leg 16*b*, and a lower generally horizontally extending leg 16*c*. Legs 16*b* and 16*c* have concave, radiused outer bearing tracks or races 24 and 24' on the lower and upper ends of the rail, respectively, and inner concave, radiused longitudinally extending tracks or races 32 and 32' on the lower and upper interfaces of legs 16*b* and 16*c*. These inner tracks receive inner, upper and lower bearings 28' and 28 which are secured in position by a single retainer 30** that extends between the two series of ball bearings.

Inner track 14 has a generally vertically oriented mounting leg or panel 14*a* with a lower leg 14*c* extending generally transversely therefrom in a generally horizontal orientation, and an upper leg 14*b* doing likewise. The outer surfaces of these two legs define elongated, radiused, arcuate ball tracks or races 34 and 34' to engage the ball bearings 28 and 28'. The inner rail has its generally C-shaped orientation opposite to the C-shaped orientation of the intermediate and outer rails. Typically, the outer rail will be mounted to a cabinet of some type and the inner rails will be mounted to a drawer or file of some type. However, this particular arrangement can be reversed with the inner rail mounted to the cabinet and the outer rail mounted to the drawer or other member to move relative to the cabinet.

Figure 3:
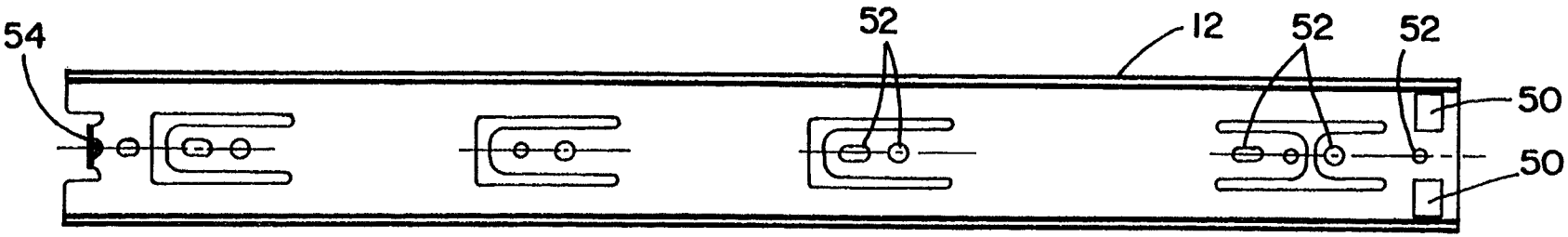
FIG. 3 is a side elevational view of the outer rail of the assembly.
Figure 4:
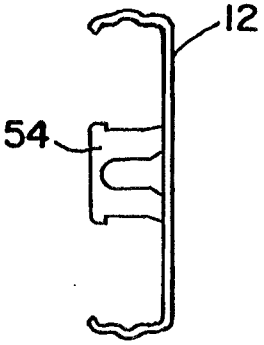
FIG. 4 is a end elevational view of the rail in FIG. 3.
Figure 6:
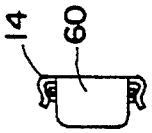
FIG. 6 is an end elevational view of the rail in FIG. 5.

The outer rail 12, as shown in FIG. 3, includes at its forward, axially outer end, a pair of vertically spaced openings 50 to receive the snap-in protrusions or lugs of the cabinet stop to be described more fully hereinafter. It also includes along its length a plurality of mounting openings 52 at spaced intervals for attachment to the inner wall of a cabinet or the like. These openings are positioned such that even when the inner rail is to be mounted in the cabinet, and the intermediate rail and inner rail are assembled but in extended condition, access can be had to the outer rail openings through openings 16i in the intermediate rail. At the inner end of the rail is a transversely extending vertically oriented tab or flange 54 which is received by the resilient inner cushion set forth in FIGS. 22–25 and to be described hereinafter. This resilient cushion is engaged by the inner stop end of the inner rail when the drawer slide is fully closed as will be described hereinafter.

Figure 1:
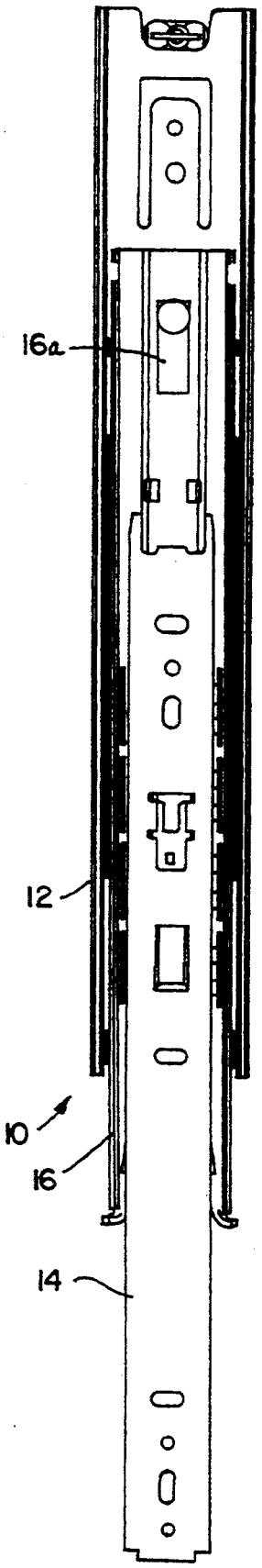
FIG. 1 is a side elevational view of a partially extended drawer slide employing the present invention.

The inner rail 14 (FIGS. 5–9) has an outer axial end flange 60 with a resilient backing material thereon for engagement with the center stop as a secondary safety stop as to be described hereinafter. Along the length of the inner rail 14 is a plurality of openings 64 for mounting the rail to a drawer. Also, openings are located at specific locations in the intermediate channel enabling access to the inner channel fastener when the slide assembly is either fully extended or fully retracted. Thus, access can be had by inserting a tool through openings, e.g., 16*n* (FIG. 1) and into engagement with the mounting screws or other fasteners used.

Figure 5:
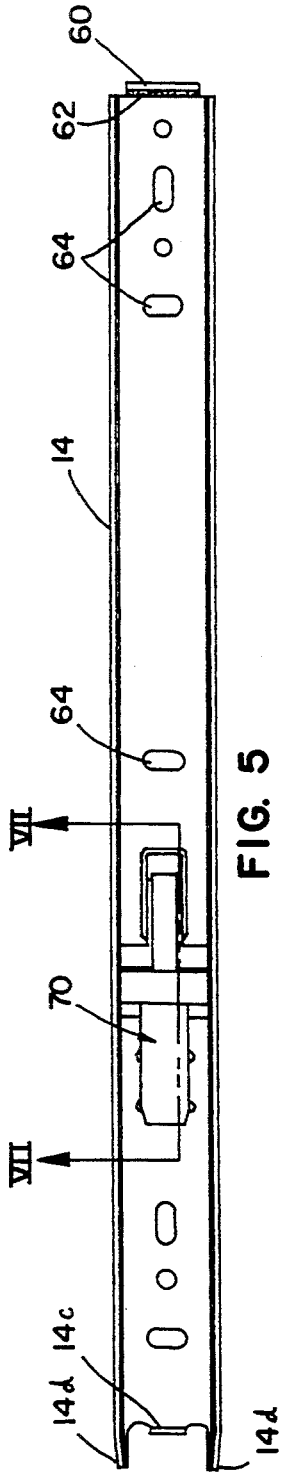
FIG. 5 is a side elevational view of the outer face of the inner rail of the drawer slide assembly, including the stop lever.
Figure 7:
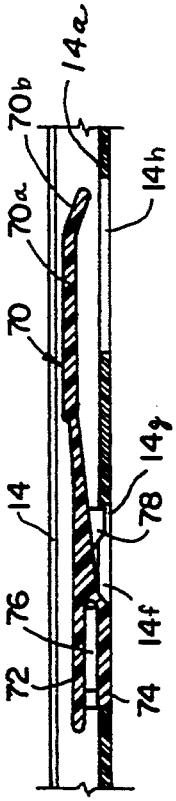
FIG. 7 is a cross-sectional, enlarged view of the lever and rail in FIG. 5, taken on plane VII—VII.

At the inner end of inner rail 14 is a pair of flanges 14*b* (FIG. 5) which slope toward each other and which engage the opposite, lower, and upper convex vertical ends of the inner cushion 120 in FIGS. 22–25 in a manner to be described hereinafter, such that the interconnection formed holds the slide assembly closed until next activated. Adjacent these flanges, but spaced axially therefrom, is a stop tab 14*e* which strikes the front surface of the inner cushion when the assembly is closed, forming the first or primary stop. Intermediate the ends of inner rail is mounted the stop lever 70 (FIGS. 5 and 7). This stop lever is a polymeric, elongated element with its several portions being of one integral molded structure. It has a rear mounting end of a fork-shaped configuration with one flange 72 thereof being an integral extension of the body of the element, and the other flange 74 being spaced from the first flange, parallel thereto, and defining a slot therebetween slidably to receive a mounting tang 76 offset from and integral with inner rail 14. Upon complete insertion of tang 76 into the slot, a laterally protruding retention abutment 78 (FIG. 7) engages in a slot 14*f* behind the shoulder 14*g* of rail 14 to keep the stop lever in cooperative association mounted on inner rail 14 until it is to be purposely removed. Removal would be by depression of abutment 78 to force it out of engagement with shoulder 14*g* and thereby allow the lever to be slid back out of its snapped-in relationship with tang 76 of rail 14.

Figure 12:
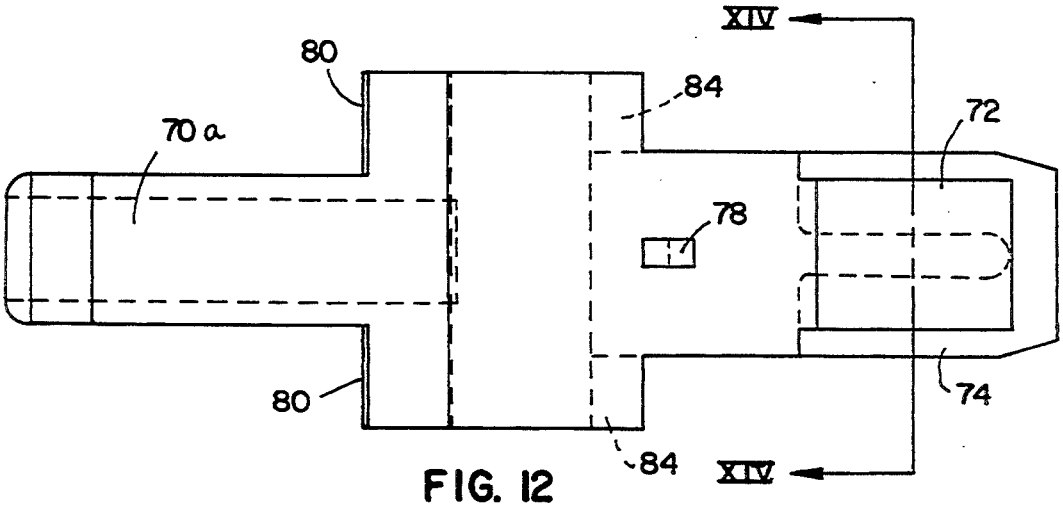
FIG. 12 is a plan view of the stop lever.
Figure 14:
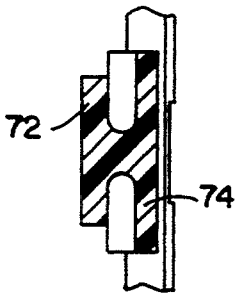
FIG. 14 is an enlarged, fragmentary, sectional view of the stop lever taken on plane XIV—XIV of FIG. 12.
Figure 13:
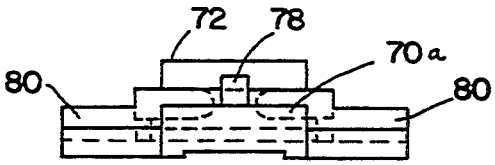
FIG. 13 is an end elevational view of the stop lever.
Figure 15:
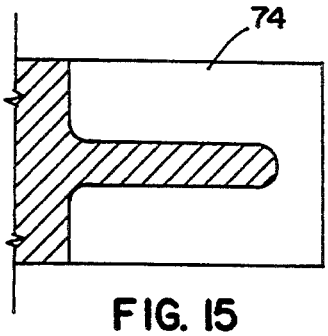
FIG. 15 is a fragmentary, enlarged, sectional view taken on plane XV—XV of FIG. 11.
Figure 10:
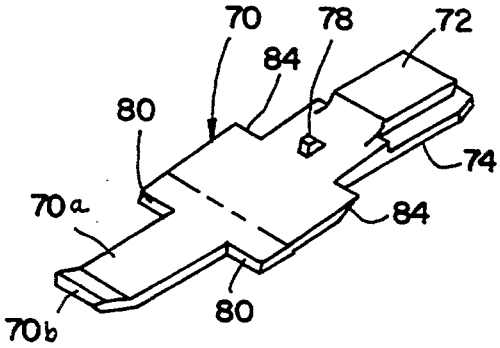
FIG. 10 is an isometric view of the stop lever.
Figure 17:
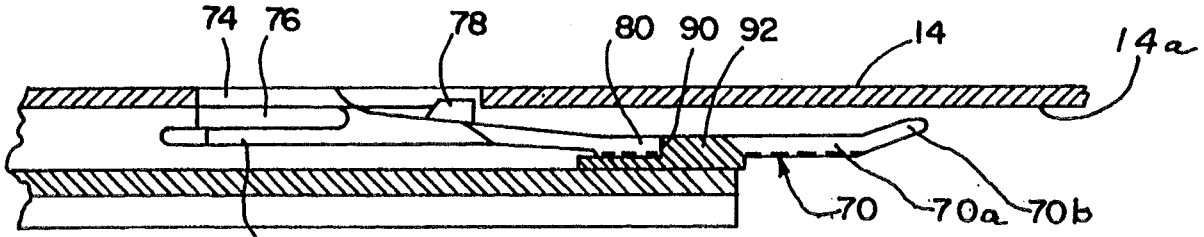
FIG. 17 is an enlarged, sectional, elevational fragmentary view of a portion of the assembly in FIG. 16 taken on the plane XVII—XVII.
Figure 18:
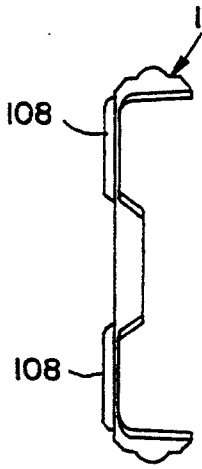
FIG. 18 is an end elevational view of the outer rail or cabinet stop of the assembly.
Figure 19:
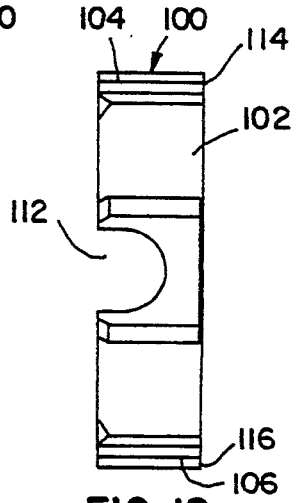
FIG. 19 is a side elevational view of the outer rail or cabinet stop.

Rail 14 also preferably includes a window or opening 14*h* adjacent the terminal trigger portion 70*a* of lever 70 to provide more space for the trigger to be resiliently laterally depressed and thereby release the stop mechanism in a manner to be described. This trigger 70*a* also preferably includes a diagonally extending terminal or end portion 70*b* which is at an obtuse angle relative to portion 70*a* that generally is parallel to rail 14. End portion 70*b* therefore projects slightly toward the inner rail wall 14*a*, and toward window 14*h* if one is used. An alternative stop lever is shown in FIG. 17. In this instance, no window or opening comparable to 14*h* is provided in rail 14. This trigger 70*a* is of resilient polymeric material with end portion 70*b* being able to engage with the wall 14*a* of rail 14 so that, upon further deformation of the trigger, it will, in effect, be in abutment with rail 14 at both ends of the lever, like a bridge, such that further depression of the trigger will bias the abutment stop shoulders 80 out of engagement with the cooperative shoulders 90 of center stop 92. This center stop 92 with its shoulders 90 is the same for both embodiments, i.e., whether window opening 14*h* is present or not. The face of these shoulders 90 is preferably at an acute angle relative to a plane perpendicular to the long axis of the slide, preferably an angle of about 15 degrees. This generally matches an acute angle of the face of abutments 80 for a special binding, interacting stop feature which has been found particularly effective to prevent accidental release of the stop members if the two components are interengaged with too much force, i.e., with more force than normally expected, as by a rapid opening of the drawer. The stop shoulders 80 preferably are arranged as a pair of such shoulders astraddle the center of lever 70 as seen more specifically in FIGS. 10 and 12. The shoulders are at the small acute angle preferably of about 15 degrees, but conceivably between about 15 degrees and about 45 degrees, with the abutment shoulders and the center stop being complementary thereto, i.e., also being about the same but opposite angle, so as to result in a binding action between the two surfaces when the engage, even if under considerable force. This has been shown by testing to produce a special locking action to prevent inadvertent release of the drawer rail components and thus of the drawer from the cabinet. Oriented toward the opposite end of the stop lever from the shoulders 80 is a pair of diagonal ramping surfaces 84 which cooperate with a similarly arranged pair of ramping shoulders 94 on legs 90 for ease of assembly insertion of the inner rail into the intermediate rail. These ramp the stop lever with a temporary bias to allow passage of the stop surfaces.

Figure 20:
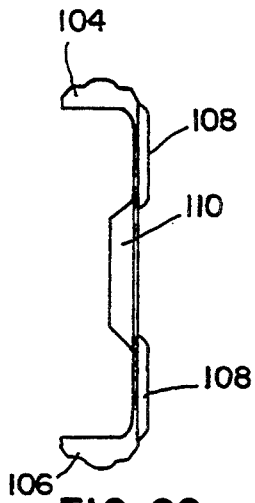
FIG. 20 is an end elevational view of the opposite end of the outer rail or cabinet stop.
Figure 21:
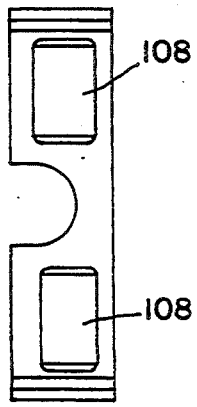
FIG. 21 is a back, side elevational view of the outer rail or cabinet stop.
Figure 23:
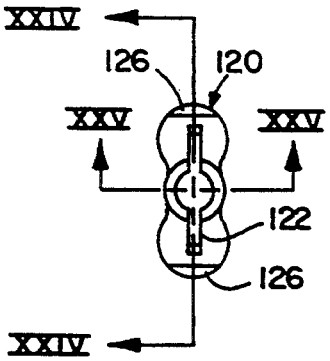
FIG. 23 is an end elevational view of the outer cushion.
Figure 24:
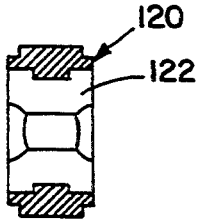
FIG. 24 is a sectional view of the inner end cushion taken on plane XXIV—XXIV of FIG. 3.
Figure 22:
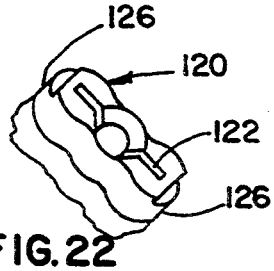
FIG. 22 is an isometric view of the outer cushion.
Figure 25:
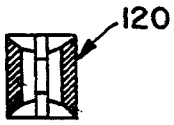
FIG. 25 is a sectional view of the cushion taken on plane XXV—XXV of FIG. 23.
Figure 30:
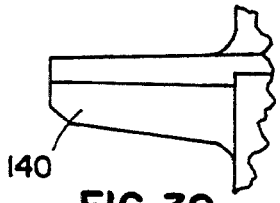
FIG. 30 is a fragmentary, greatly enlarged view of one of the bridging fingers on the center stop in FIGS. 26–29.
Figure 28:
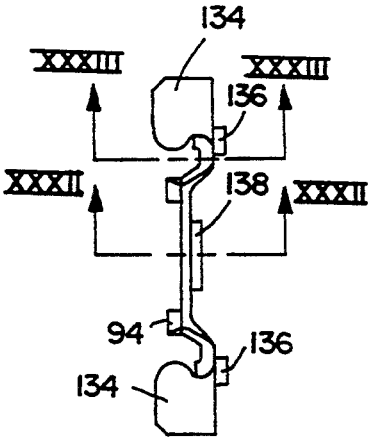
FIG. 28 is an end elevational view of the outer end of the center stop.
Figure 29:
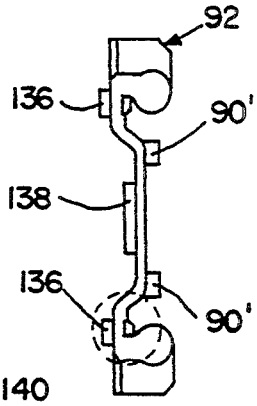
FIG. 29 is an end elevational view of the inner end of the center stop.
Figure 27:
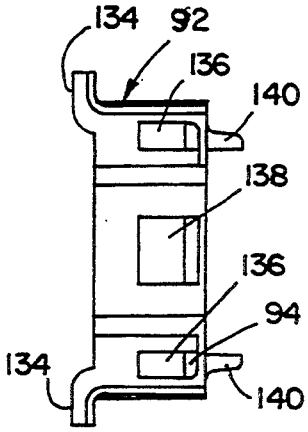
FIG. 27 is a side elevational view of the outer face of the center stop.
Figure 26:
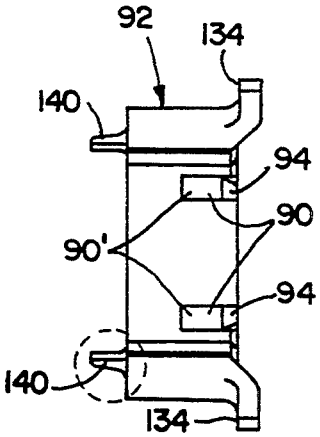
FIG. 26 is a side elevational view of the inside face of the center stop.
Figure 31:
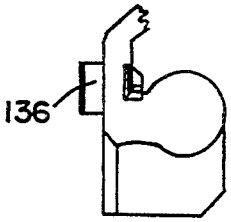
FIG. 31 is a greatly enlarged, end elevational, fragmentary view of a portion of the center stop in the circle shown in FIG. 29.
Figure 33:
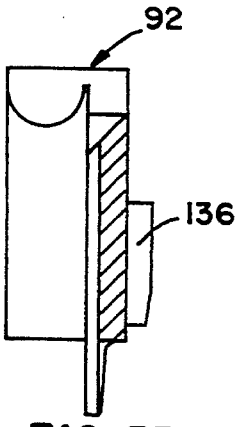
FIG. 33 is a sectional view taken on plane XXXIII—XXXIII in FIG. 28.
Figure 32:
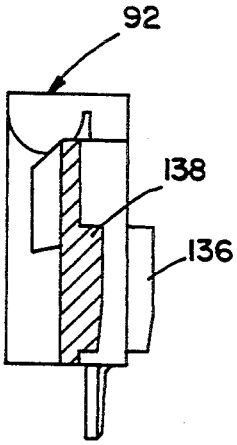
FIG. 32 is a sectional view of the center stop taken on plane XXXII—XXXII of FIG. 28.
Figure 34:
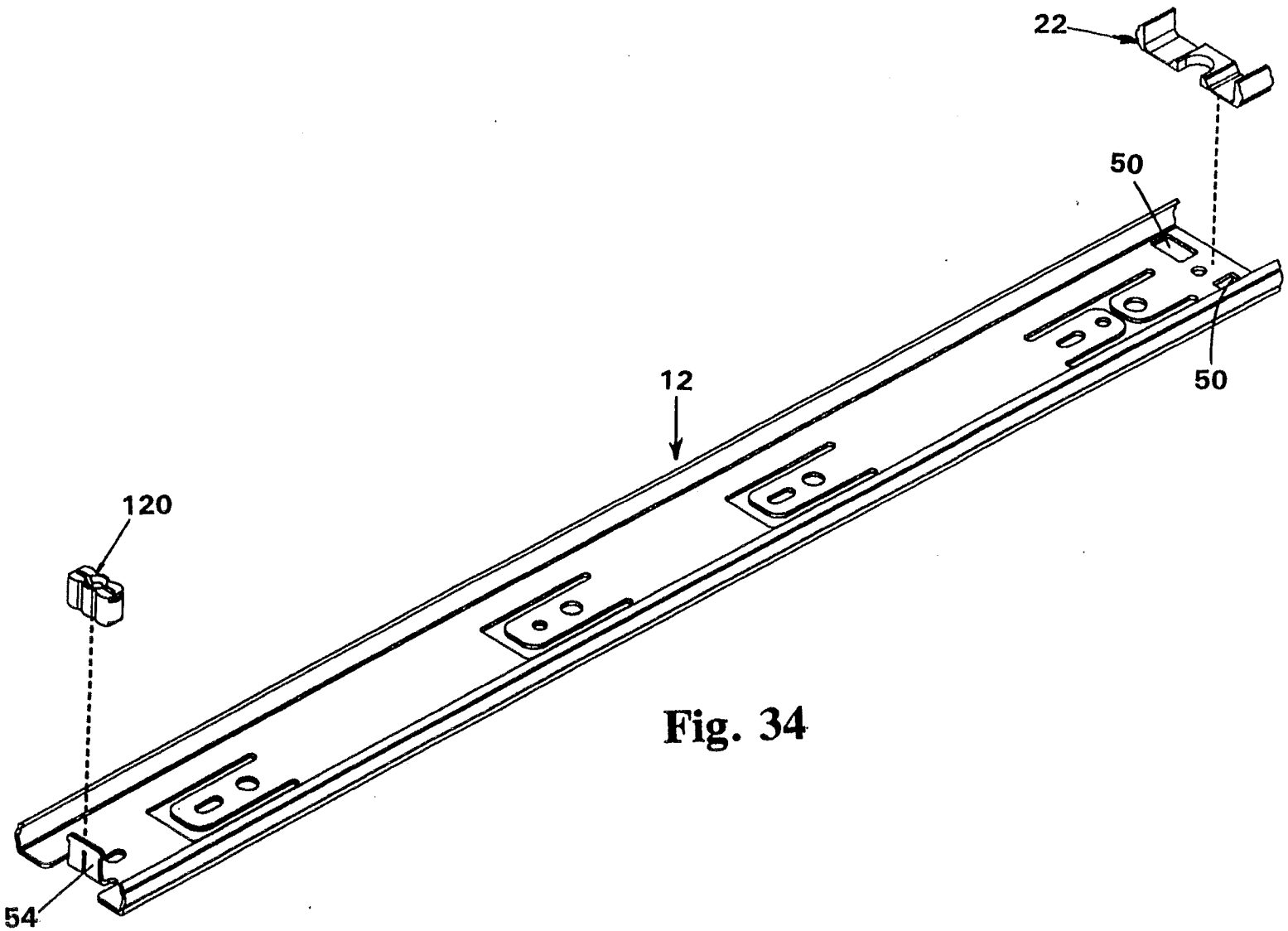
FIG. 34 is an exploded perspective view of an outer rail for the drawer slide according to FIG. 1.
Figures 35, 36:
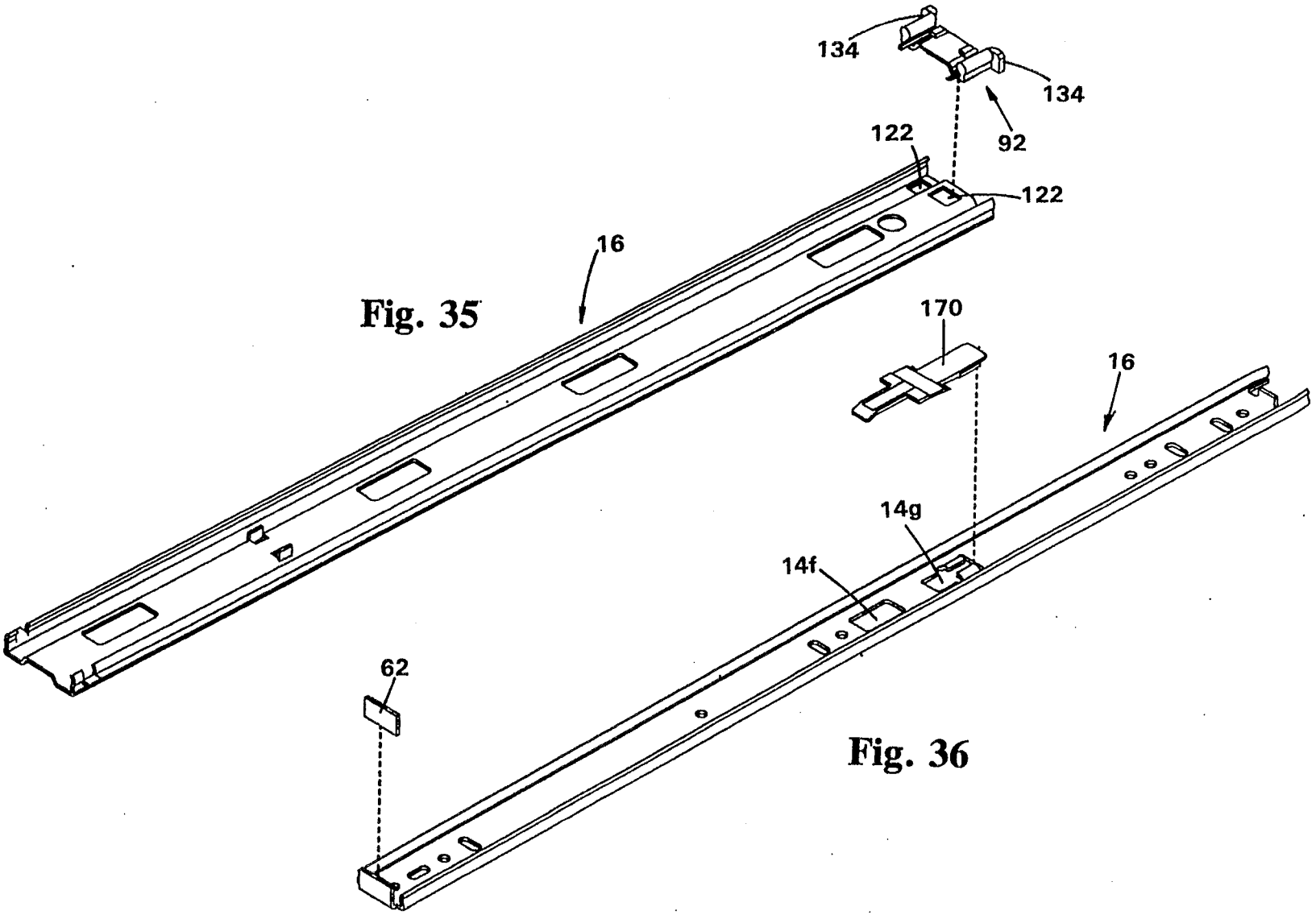
FIG. 35 is an exploded perspective view of a center rail for the drawer slide according to FIG. 1.
FIG. 36 is an exploded perspective view of an inner rail for the drawer slide according to FIG. 1.

Also formed of an integral polymeric molded structure is the cabinet or outer rail stop 100 (FIGS. 18–21). Cabinet stop 100 basically has a polymeric body extending the height of the outer rail, the body 102 having an upper transverse flange 104 and a lower transverse flange 106 which are positioned in the bearing races and against the upper and lower legs of the outer rail when assembled. The polymeric element is snap-fitted into openings 50 (FIG. 3) of outer rail 12 with insertion of a pair of snap lugs 108 on the back face of body 102 (FIG. 21 ). In the central portion of the front face is a bearing protrusion 110 which engages the offset central portion 16*d* (FIG. 2) of the intermediate rail 16, whereas the inner parts of the body 102 astraddle this projection 110 form a bearing surface for the portions of intermediate rail 16 astraddle the offset 16*d*. Bearing protrusion 110 can have an orifice 112 therein matching an orifice 52 (FIG. 3) in the outer rail for insertion of a fastener. The edges 114 and 116 of flanges 104 and 106 serve as stop elements which are engaged by a pair of outwardly extending wings 134 and 136 of the center stop 92 (FIGS. 26–31) to be described hereinafter, when the slide is closed or contracted.

Figure 16:
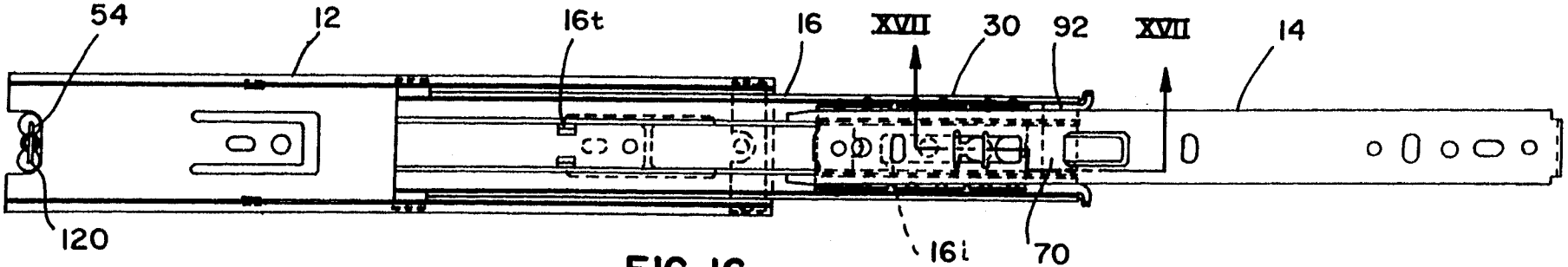
FIG. 16 is a side elevational view of a drawer rail assembly of an embodiment with no window in the inner rail to receive the stop lever trigger.

In FIGS. 22–25 is shown the resilient inner cushion 120 which is mounted on transverse flange or tab 54 (FIG. 3) of outer rail 12 at the inner end of this outer rail. This stop element is shown to be shaped somewhat like a FIG. 8, being vertically positioned in the orientation of the rail assembly depicted, and having an elongated central vertical slot 122 for receiving flange 54 as depicted in FIG. 16. The upper and lower ends of cushion 120 are preferably convexly curved, with the overall height dimension of this cushion being slightly greater than cooperative vertical spacing between the two flanges 14*d* at the inner end of inner rail 14 (FIG. 5). Thus, when the inner rail is almost fully closed, and just before stop flange 14*e* on the inner rail engages the axial face of cushion 120, the straddling flanges 14*d* will engage and slightly resiliently deform the curved upper and lower surfaces 126 of stop cushion 120 to provide a smooth closing and to serve a holding function to retain the drawer slide in contracted condition until again purposely extended. When cushion 62 hits center stop 92, it will compress a small amount and then flange 14*c* will engage cushion 120. At that point, the position of rail 14 will be such that cushion 62 (FIG. 5) will be in contact with center stop 92 and also the face of protrusion 10 on element 100 (FIG. 20).

Referring now to FIGS. 26–31, the center stop 92 is there depicted. As noted previously, this center stop has two stop shoulders 90 with diagonal inwardly oriented acute angle faces 90' on the inside face of the component 92. On the rear face are three protruding snap-in lugs or protrusions 136 and 138 which form a snap fit with corresponding openings at the outer end of the intermediate rail. On the outer end of element 92 is the pair of wings 134 serving as stop surfaces when engaging the outer end 114 of cabinet stop 100 (FIG. 19) when the intermediate rail is fully closed into the outer rail. This polymeric member also serves as a resilient bushing have lubricous properties, for preventing rail to rail metal contact of the inner rail to the intermediate rail if the slide assembly is torsionally twisted.

On the opposite inner end of element 92 is a pair of special tapered, resilient, projecting fingers 140 (FIGS. 26 and 30) integral with the element, spaced from and parallel to each other, and spaced from the outermost plane of element 92 to overlap the metallic bearing retainer 30 in a position of the retainer adjacent the center stop. By extending slightly over the edge of the bearing retainer, this is beneficial when the inner rail is inserted longitudinally into engagement with the intermediate rail. Specifically, the inner rail will be guided by the fingers over the bearing retainer to prevent the inner end of the inner rail from engaging the end of the bearing retainer so that the latter will not be axially shifted by the end of the inner rail to cause difficulty of assembly. Rather, the inner end of the inner rail slides over the fingers which also help to retain the bearing retainer, and into engagement with the ball bearings themselves, for optimum interengagement insertion.

The inner end of element 92 also serves to limit actual movement of the outer axial end of the bearing retainer 30 (FIG. 2) the movement of the inner axial end of the bearing retainer 30 is limited by the collector or collectors tabs 161 (FIG. 16). These collectors 161 are specially located relative to the outer end of the intermediate rail such that optimum positioning of the rail members occurs with respect to each other. That is, these inner collector tabs are so located so that ball retainer 30 does not strike center stop 92 at full extension, under normal conditions. Because the retainer moves at one-half the speed and one-half the distance of the inner rail when extended, with proper placement of collector tabs 161, that is, greater than the length of retainer 30 plus one-half of the travel distance of rail 14 relative to rail 16, the retainer will not normally strike but will stop closely adjacent to but short of center stop 92. If, however, stop lever 70 is actuated to receive rail 14 from slide assembly 10, movement of retainer 30 will be restrained by center stop 92.

It will be realized that this entire assembly is composed of components that require no riveting, forming or staking of the metal, but rather, can be assembled or disassembled easily and quickly, even without tools. Thus, even if some of the components should become worn, for example, they can be readily removed and replaced, without tools, in a matter of seconds.

Another significant advantage of the assembly is that the components will not scrape, metal on metal, even under torsional loads, because the polymeric components which serve the functions of stops and guides, also form guide bushings between the slide elements. Further, the slide assembly can be mounted in a cabinet or the like and subsequently adjusted at full extension without removing the drawer. It has direct access openings or windows through the intermediate rail and the center member to allow an installer to insert the mounting screws into rail 14 without removing rail 14 from the slide assembly. The openings extend clear through the structure and all of its components for mounting when it is in contracted or closed condition.

The lead-in ramps on both the drawer, i.e., the inner rail and the outer cabinet rail, allow for fast self-alignment when inserting the drawers. This is significant because the drawer is often inserted without being able to see the components interengaging.

Extensive testing has been conducted on this novel slide assembly. Such testing has shown that the unit has a wear life substantially longer than competitive units presently available either from the Assignee herein or its competitors. The structure operates accurately and smoothly, being readily assembled into a slide assembly with mere snap insertion of polymeric components and interleafing of the rails or channels. Moreover, the inner drawer rails when mounted on a drawer, can be easily removed from the remaining components simply by flexing the two opposite triggers of the stop levers laterally inwardly toward the drawer walls in an ergonomically compatible fashion. Reinsertion of the drawer and the two drawer rails mounted thereto can be readily made into the remaining slide structure by simply pushing the rails telescopingly together. This action forces the ramping surfaces of the cooperating stop levers and stops into ramping relationship, resulting in movement of the stop levers past the stops into secured condition. The special acute angle relationship of the stop surfaces and the stop levers and stops assures stoppage even under abrupt drawer opening conditions.

It is entirely conceivable that those skilled in the art, once they review this disclosure, will think of various changes which can be made to adapt the unique slide structure to certain situations. Thus, the invention is not intended to be limited specifically to the preferred illustrative forms set forth herein but only by the scope of the appended claims and a reasonably equivalent structure by those defined therein.

The embodiments of the invention in which an exclusive property or privilege is claimed are defined as follows:

1. A drawer slide assembly comprising:

telescopically interconnected metal channels, respective ones of which are adapted to be connected to a drawer and a cabinet;

polymeric stop elements on each of said channels, said channels and said stop elements being resiliently connectable and releasable with one another whereby said stop elements can be removed from said channels and recycled.

2. The drawer slide assembly as defined in claim 1, wherein said polymeric stop elements include at least one first polymeric stop element for limiting the extended open length of the drawer slide assembly and at least one second polymeric stop for setting the retracted closed length of the drawer slide assembly.

3. The drawer slide assembly as defined in claim 2, further including a polymeric bearing retainer for holding bearings at a predetermined spacing, said holder and bearings press fit between two of said channels, such that the bearings rotate within the channels during sliding movement of the channels and the bearings and retainer may be readily disassembled from the channels for recycling.

4. The drawer slide assembly as defined in claim 2, wherein said channels include generally C-shaped cross sections, and said second stop elements conform to the shape of said channels.

5. The drawer slide assembly as defined in claim 2, wherein said at least one second stop element includes a drawer channel stop member attached to the drawer channel by press fitting.

6. The drawer slide assembly as defined in claim 5, wherein said drawer channel stop member includes a body which is generally C-shaped in profile and including protrusions for mating engagement with recesses in said drawer channel.

7. The drawer slide assembly as defined in claim 6, wherein said body further includes a projection adapted to be inserted into an aperture of said one channel to prevent movement of said body in the direction of travel of said channel members.

8. The drawer slide assembly as defined in claim 2, wherein said second stop elements include a center channel stop element having a body adapted to be press-fit into said center channel.

9. The drawer slide assembly as defined in claim 8, wherein said center channel stop element includes conforming projections adapted to mate with said center channel.

10. The drawer slide assembly as defined in claim 9, wherein said center channel stop further includes a projection adapted to be received in an aperture of said center channel to prevent lateral movement of said center channel stop.

11. The drawer stop assembly as defined in claim 10, wherein said center channel stop further includes a flange adapted to engage an end of the center channel.

12. The drawer slide assembly as defined in claim 2, wherein said first polymeric stop element includes a body adapted to be positioned adjacent an aperture in one of said metal channels and at least one projection for preventing lateral movement of said first stop element.

13. A drawer slide assembly comprising:

telescopically inter fit rails adapted to be connected to a drawer and a cabinet to support the drawer for sliding movement between open and closed positions on the cabinet, said rails constructed from metal;

bearings positioned between said rails to facilitate sliding movement of said rails;

at least one bearing retainer for holding said bearings between said rails;

stops for limiting the movement of said rails when moving between the open and the closed positions;

wherein said bearing retainer and said stops are resiliently and releasably mounted on said channels whereby said stop elements and said bearing retainers may be removed from said rails for recycling.

14. The drawer slide assembly as defined in claim 13, wherein said one of said metal channels includes at least one tang adjacent said aperture for engaging said body.

15. The drawer slide assembly as defined in claim 14, wherein said first stop element includes a trigger portion which is flexed to release said first stop element for removal of said second stop element.

16. A drawer slide assembly comprising:

metal rails having different dimensions for positioning within one another, one of said rails for connection to a drawer and another one of said rails for connection to a cabinet;

at least one bearing assembly including a polymeric retainer and metal bearings, said bearing assembly adapted to be press fit between rails; and polymeric stop members adapted to be press fit onto said rails, whereby said bearing assembly and said stop members may be readily separated from said channel members to facilitate disassembly of the drawer slide for recycling.

17. The drawer slide assembly as defined in claim 16, wherein said polymeric stop elements include at least one first polymeric stop element for limiting the extended open length of said drawer slide assembly and at least one second polymeric stop element for setting the retracted closed length of said drawer slide assembly.

18. The drawer slide assembly as defined in claim 17, wherein said second polymeric stop elements include a stop member having a body which is generally C-shaped in profile and including protrusions for mating engagement with recesses in said one of said channel members.

19. The drawer slide assembly as defined in claim 18, wherein said metal rails include a center rail and wherein said second polymeric stop elements include a stop member having conforming projections adapted to mate with said center rail.

20. The drawer slide assembly as defined in claim 19, wherein each of said stop members further includes a projection adapted to be received in an aperture of its associated rail.

21. The drawer slide assembly as defined in claim 20, wherein said first polymeric stop element includes a body adapted to be positioned adjacent an aperture in one of said rails and at least one projection for preventing lateral movement of said first stop element.

* * * * *

UNITED STATES PATENT AND TRADEMARK OFFICE

CERTIFICATE OF CORRECTION

PATENT NO. : 5,411,333

DATED : May 2, 1995

INVENTOR(S) : Keith A. Hoffman

It is certified that error appears in the above-indentified patent and that said Letters Patent is hereby corrected as shown below:

Column 1, line 12;

"tile disclosures" should be –the disclosures–.

Figure 8:
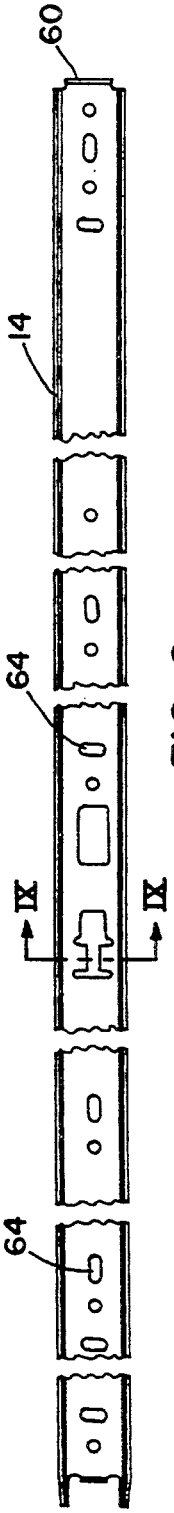
FIG. 8 is a side elevational view of the inner rail without the stop lever.
Figure 9:
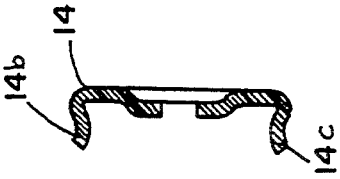
FIG. 9 is a cross-sectional view of the inner rail taken on plane IX—IX of FIG. 8.
Figure 11:
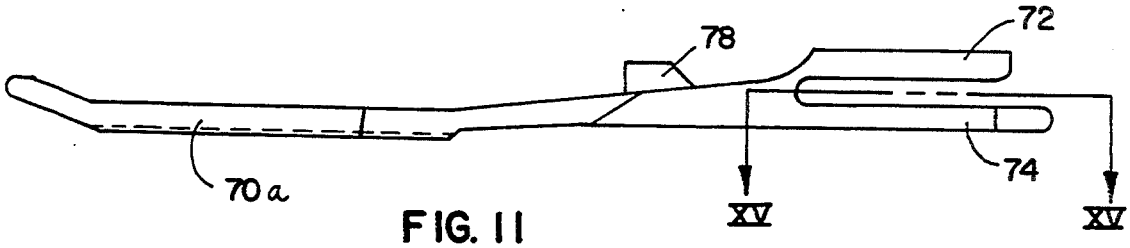
FIG. 11 is an enlarged, side elevational view of the stop lever.

Column 7, line 20;

"FIG. 8" should be –figure 8–.

Column 8, line 10;

"161" (both occurrences) should be —16t—

Column 8, line 19;

"161" should be —16t—

Signed and Sealed this

Twenty-seventh Day of February, 1996

Bruce Lehman

*Attest:*

BRUCE LEHMAN

*Attesting Officer*

*Commissioner of Patents and Trademarks*